United States Patent [19]

Labbe

[11] 4,095,604

[45] Jun. 20, 1978

[54] CIGARETTE-MAKING MACHINES

[75] Inventor: Francis A. M. Labbe, Neuilly-sur-Seine, France

[73] Assignee: Molins Limited, London, England

[21] Appl. No.: 674,197

[22] Filed: Apr. 6, 1976

Related U.S. Application Data

[63] Continuation of Ser. No. 415,470, Nov. 11, 1973, abandoned.

[30] Foreign Application Priority Data

Nov. 15, 1972 United Kingdom ..... 52718/72

[51] Int. Cl.[2] ..... A24C 5/39

[52] U.S. Cl. ..... 131/21 A; 131/81 A; 131/84 R; 131/109 B

[58] Field of Search ..... 131/21 A, 108, 109, 131/84 A, 84 B, 84 C, 110, 21 R, 81 R, 81 A

[56] References Cited

U.S. PATENT DOCUMENTS

| | | | |
|---|---|---|---|
| 406,612 | 7/1889 | Allison | 131/109 R UX |
| 1,183,618 | 5/1916 | Aiton | 131/109 R |
| 1,466,322 | 8/1923 | White | 131/109 R |
| 1,724,319 | 8/1929 | Schuneman | 131/109 R |
| 1,781,239 | 11/1930 | Molins | 131/109 R |
| 1,817,319 | 8/1931 | Muller | 131/109 R |
| 2,269,116 | 1/1942 | Lehman | 131/109 R |
| 2,286,306 | 6/1942 | Randolf | 131/109 R X |
| 2,989,055 | 6/1961 | Labbe | 131/21 A |
| 3,004,539 | 10/1961 | Molins | 131/109 R |
| 3,062,357 | 11/1962 | Molins | 131/21 A UX |
| 3,070,847 | 1/1963 | Schwab | 131/21 AU X |
| 3,189,034 | 6/1965 | Molins | 131/8 RC |

FOREIGN PATENT DOCUMENTS

| | | | |
|---|---|---|---|
| 241,274 | 10/1962 | Australia | 131/84 C |
| 1,099,317 | 3/1955 | France | 131/21 A |
| 662,003 | 7/1938 | Germany | 131/21 A |
| 385,946 | 2/1933 | United Kingdom | 131/21 A |

*Primary Examiner*—Robert W. Michell
*Assistant Examiner*—V. Millin
*Attorney, Agent, or Firm*—John C. Smith, Jr.

[57] ABSTRACT

A hopper for a cigarette making machine comprises means for delivering tobacco continuously into a space defined partly by a spiked drum arranged to carry tobacco continuously from the space and towards a picker roller which removes the tobacco from the spiked drum and projects it into the upper end of a downwardly extending channel in which the tobacco piles up to form a carpet, at least one wall of the channel being movable in order to feed the carpet of tobacco downwards through the channel, and including a conveyor at the lower end of the channel for receiving the carpet from the channel and for feeding the carpet towards a device for forming a cigarette filler stream from the carpet.

35 Claims, 6 Drawing Figures

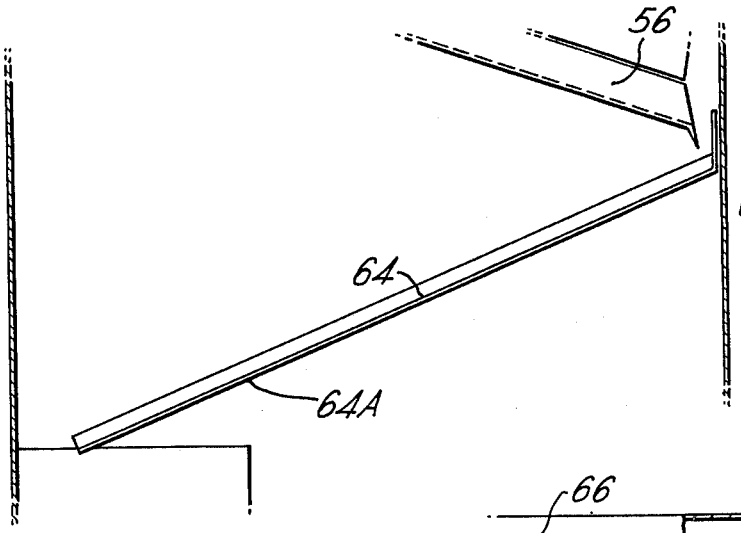
FIG.4.
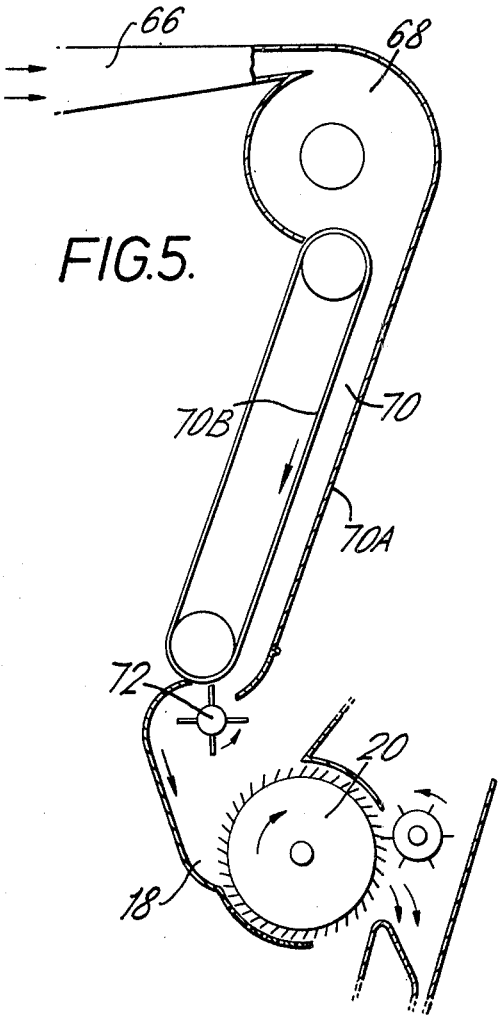
FIG.5.
FIG.3.
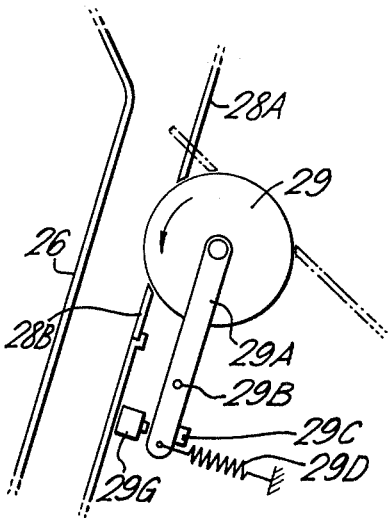

CIGARETTE-MAKING MACHINES

This is a continuation, of application Ser. No. 415,470 filed Nov. 11, 1973 now abandoned.

This invention is concerned particularly with the hopper section of a cigarette making machine, in which a carpet of tobacco is formed, this carpet being fed towards a rod-forming section of the machine in which the carpet is, for example, showered on to a band to form a tobacco stream; this stream is enclosed in a continuous wrapper web to form a continuous cigarette rod which is then cut at regular intervals.

In this specification the term "cigarette" will be used with the intention that it should be regarded as including other similar articles for smoking. The term "tobacco" will be used with the intention that it should be regarded as including any material or mixture of materials which may be used to form the filler of a cigarette or other similar article for smoking.

According to one aspect of this invention a hopper for a cigarette making machine comprises means for delivering tobacco continuously into a space defined partly by a spiked drum arranged to carry tobacco continuously from the space and towards a picker roller which removes the tobacco from the spiked drum and projects it into the upper end of a downwardly extending channel in which the tobacco piles up to form a carpet, at least one wall of the channel being movable in order to feed the carpet of tobacco downwards through the channel, and including a conveyor at the lower end of the channel for receiving the carpet from the channel and for feeding the carpet towards a device for forming a cigarette filler stream from the carpet.

By means of the spiked drum and picker roller, the tobacco can be loosened to some extent so as to be able to enter a relatively thin channel, for example 11 to 15 mm thick. This enables the tobacco to be packed into the channel at a relatively high density (not very much lower than the density desirable for the picking of the tobacco after it has passed through the channel, e.g. by the picker roller 32 shown in FIG. 1); this is desirable as it reduces the tendency for tobacco shorts to separate out of the tobacco in the channel.

Another aspect of this invention is concerned generally with cigarette making machines including discard means for removing tobacco (which will be termed "discard tobacco") from the tobacco as compared with "new" tobacco which is not removed stream before the latter is enclosed in a continuous wrapper web to form a continuous cigarette rod. A machine according to this aspect of the invention has a hopper comprising a downwardly extending channel, means for feeding into the upper end of the channel, across part of the width thereof, new tobacco delivered into the machine, means for feeding at least some of the discard tobacco into the upper end of the channel across another part of the width of the channel alongside the first-mentioned part, whereby a carpet of tobacco is built up in the channel, formed of side-by-side portions respectively of new tobacco and discard tobacco; and including means for continuously feeding the carpet of tobacco from the lower end of the channel and for forming the carpet into a tobacco stream.

The discard tobacco may, for example, be tobacco obtained from the tobacco stream by the removal of the outer layer of the tobacco stream (for example by means of a trimming device), or tobacco removed as complete regularly-spaced sections of the tobacco stream to make room for filter sections, for example as described in U.S. Pat. No. 1,963,076.

The new tobacco may be fed into the channel from a reservoir space by one or more spiked conveyors, partly for the purpose of loosening it. The discard tobacco, however, bypasses such spiked conveyors and is instead fed directly into the channel; thus the discard tobacco, which is already loosened and winnowed, can be formed into part of the final carpet without significant further degradation such as would result if it were fed into the reservoir space (where it would tend to become entangled and lumpy) and then together with the new tobacco via the spiked conveyor or conveyors.

Shorts separating out of the new tobacco on its way to the channel may be collected and fed on to the part of the tobacco carpet (after it has emerged from the channel) which is formed from discard tobacco. This is believed to be useful because the mixture of discard tobacco and shorts has a filling power which is not very different from that of the new tobacco; i.e. the filling power is not as high as that of the discard tobacco and is not as low as that of the shorts.

Other aspects and preferred features of this invention will be understood by reference to the appended claims.

Examples of cigarette making machine hoppers according to the present invention are shown in the accompanying diagrammatic drawings. In these drawings:

FIG. 3 is an enlargement of a device forming part of FIG. 1 identified by an arrow III, FIG. 4 shows a modification of one part of the hopper shown in FIGS. 1 and 2;

FIG. 5 shows a modification of another part of the hopper shown in FIGS. 1 and 2.

Figure 1:
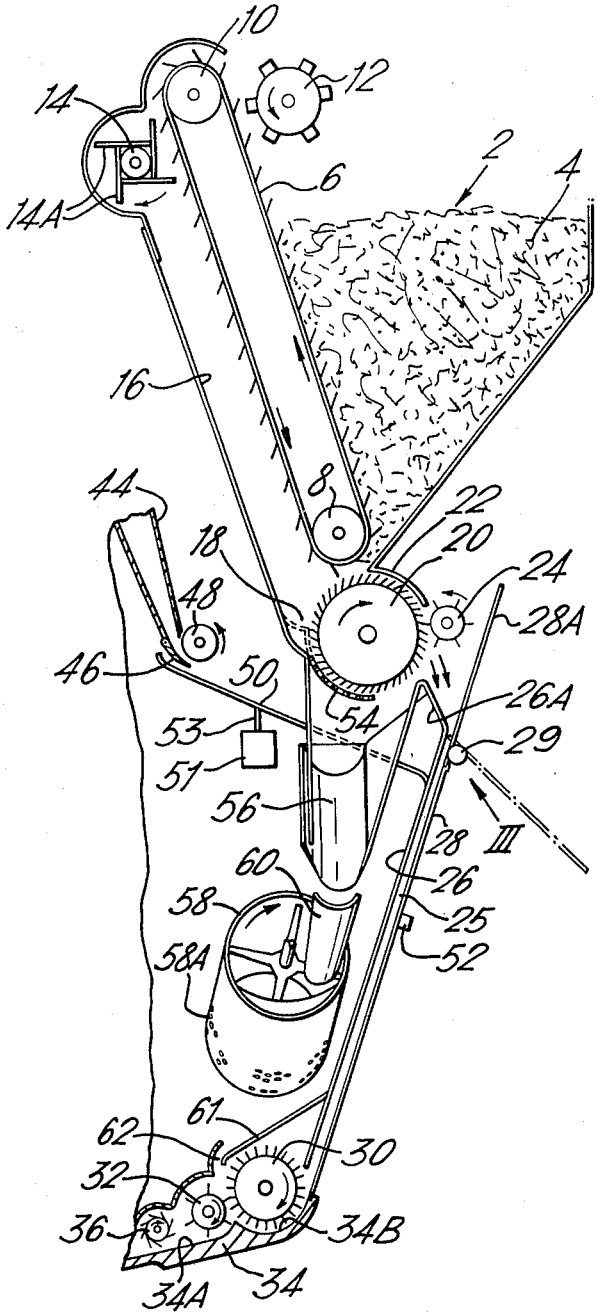
FIG. 1 is a section in a vertical plane through one hopper.

A cigarette-making machine, described for example in U.S Pat. No. 3,338,247, is illustrated diagrammatically in FIG. 6. The filler stream 102 from the hopper 1 is conveyed past means 103 for removing discard tobacco 104 which is returned to the hopper. The remaining filler stream is then wrapped in a continuous wrapper web by wrapping means 105 for forming a continuous wrapped rod 106.

The cigarette machine hopper shown in FIG. 1 includes a reservoir space 2 into which new tobacco 4 is delivered. A spiked band 6 passing around two pulleys 8 and 10 carries tobacco upwards from the reservoir space, the amount of tobacco carried up by the band 6 being controlled by a roller 12. Soon after passing around the upper pulley 10, the tobacco on the band 6 is removed by a rotating roller 14 carrying leather flaps 14A, and this tobacco then falls downwards along a wall 16 and into a space 18 between a carded drum 20 and the lower end portion of the wall 16.

The carded drum 20 rotates by means of shaft 20A in a clockwise direction, at a peripheral speed which is much higher than the speed of the band 6, and carries from the space 18 a loose carpet of tobacco. The capacity of the drum 20 to carry tobacco is significantly greater than the rate at which tobacco is delivered to the space 18 by the band; thus the tobacco is carried away by the drum 20 substantially as soon as it arrives in the space 18, and does not accumulate in the space 18. A curved plate 22 helps to retain the carpet on the drum 20 until just upstream of a picker roller 24 driven by shaft 24A and which removes the tobacco from the drum 20 and throws it into a downwardly extending channel 25 formed by an outer wall 28 of the hopper and by a substantially parallel inner wall 26, the upper end of the wall 26 being inclined at 26A so as to provide a wide mouth into the channel 25.

Thus the tobacco piles up in the channel 25 to form a tobacco carpet. The outer wall 28 is fixed, though it is readily removable (by means not shown) to provide access inside the channel, but the inner wall 26 vibrates bodily in a substantially vertical direction so as to cause or assist the downward movement of the carpet of tobacco through the channel 25. The walls 26 and 28 forming the channel 25 diverge slightly in a downward direction.

The tobacco delivered from the lower end of the channel 25 is carried further by a carded roller 30 and is then removed from the roller 30 by a picker roller 32 which projects the tobacco along a surface 34A of a plate 34. A high-speed ribbed projector roller 36 projects the tobacco at a higher speed from the plate 34, from which point the tobacco may (preferably after being winnowed), pass into a shower channel through which the tobacco is showered towards a band to form a cigarette filler stream, for example, as described in British Pat. No. 895,733 or U.S. Pat. No. 3,613,692; alternatively, the tobacco may pass on to a suction drum on which it is progressively narrowed to form a filler stream basically as described in French Pat. No. 1,585,115.

Discard tobacco removed from the filler stream is delivered into a chute 44. If the discard tobacco is fed pneumatically into the chute 44, a pivoted flap 46 is included, this being spring-loaded towards a roller 48 rotating in an anti-clockwise direction so as to form an air seal. A sloping plate 50 which thus receives the discard tobacco forms part of a vertically vibrating assembly including the wall 26 of the channel 25. Thus the discard tobacco is fed down the plate 50.

Figures 2, 6:
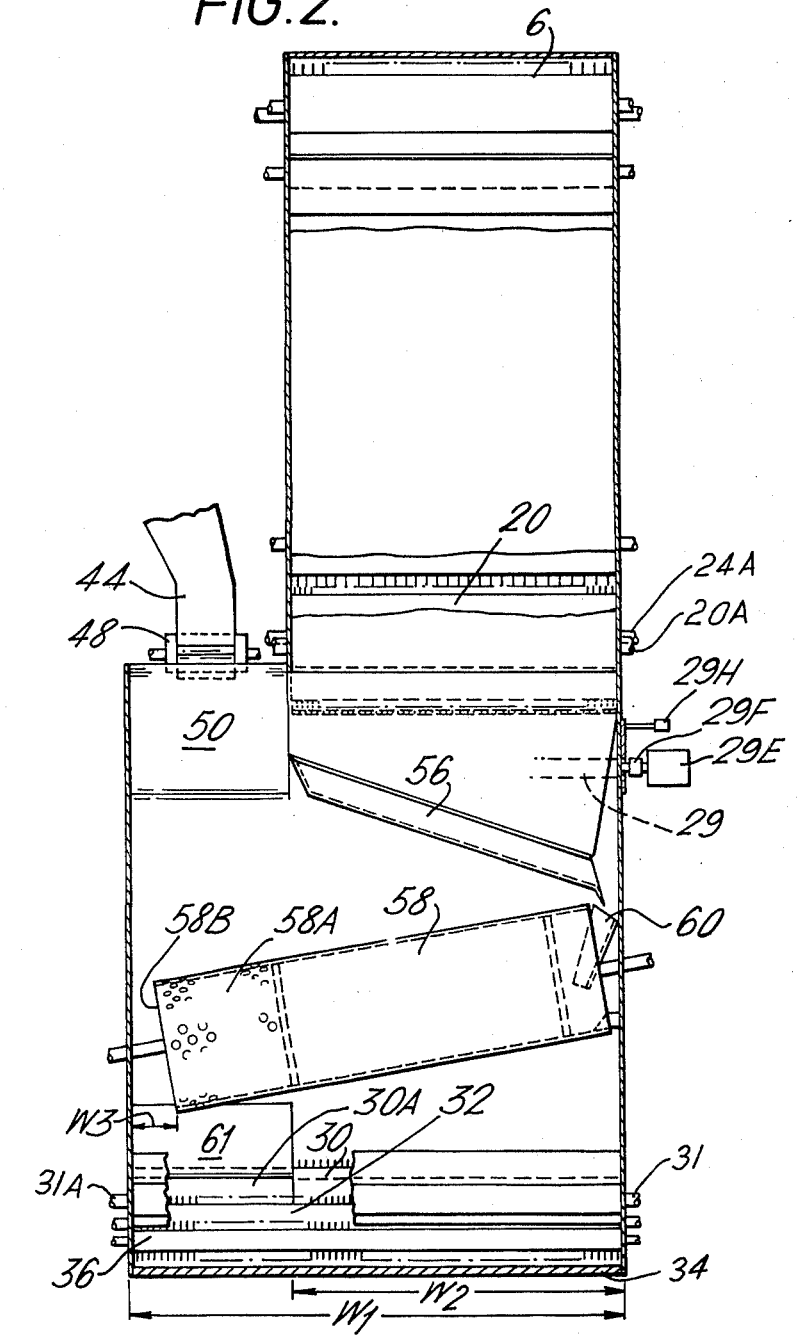
FIG. 2 is a view from the left of FIG. 1, but with parts omitted to show the internal details.
FIG. 6 diagrammatically illustrates a cigarette making machine including the hopper.

As shown in FIG. 2, the complete width of the carpet of tobacco delivered from the plate 34 is the dimension shown as W1. This dimension may, for example, be about 60 centimeters. However, the spiked band 6 and all the parts (including the space 18) associated with it occupy only a width W2. Thus only part of the carpet delivered from the plate 34 is received from the reservoir space 2 wherein this part of the carpet is W2. The remainder of the carpet is formed from discard tobacco, this being delivered by the plate 50 into a portion of the channel 25 which lies alongside the portion into which the tobacco is delivered from the reservoir space 2. The carded roller 30, driven by shaft 31 has a width corresponding to that of the reservoir space 2, and there is a second carded roller 30A (see FIG. 2) which is coaxial with the roller 30, rotates independently of the roller 30 driven by shaft 31A and feeds the carpet section comprising discard tobacco onto the plate 34. The picker roller 32 and projector roller 36 extend across the whole width of the plate 34.

The radial gap between the cylindrical body of the roller 30 and the co-operating surface 34B of the plate 34 is of the same order as (being only slightly less than) the thickness of the channel 25; this is in order to increase slightly the density of the tobacco column or carpet for the purpose of the picking operation by the picker roller 32. The channel thickness may, for example, be 11 to 15 mm and the gap 9 mm; in a preferred example, the channel thickness is 12 mm and the density of the tobacco in the channel is about 100 mg/cc, while the density of the tobacco in the gap is 120–130 mg/cc. However, the discard tobacco, being already loosened and winnowed and substantially free of lumps, can be, and preferably is, picked while at a lower density. Accordingly, the drum 30A may be of slightly smaller diameter than the drum 30, giving a larger gap. Alternatively the thickness of the channel 25 may be less in the region of the discard tobacco, for example 9 mm, and the gap around the roller 30A may be 8 mm, again giving a smaller increase in density around the roller than in the case of the new tobacco, while making use of the ability of the discard tobacco (on account of the fact that it is looser and has been winnowed) to be formed into a thinner column.

In the event of a comparatively large, hard foreign body reaching the entry to the channel 25, a device III (shown enlarged in FIG. 3) is arranged to eject the foreign body. This ejection device includes a horizontal roller 29 which projects slightly into the channel 25 across the whole width of the channel, leaving a gap between the roller and the wall 26 of, for example, 8 mm. The roller is carried by a member 29A which is pivoted at 29B and is normally held against a stop 29C by a spring 29b.

A motor 29E (see FIG. 2) drives the roller, in the direction shown, via a friction clutch 29F. When a comparatively large foreign body tries to enter the channel 25, it wedges between the roller 29 and the wall 26, as a result of which the roller stops rotating and is forced back against the action of the spring 29D, whereupon the member 29A operates a switch 29G. This immediately causes a device 29H (shown diagrammatically in FIG. 2) to rotate parts 28A and 28B of the wall 28, which are pivoted about the axis of the roller 29, rapidly to the positions shown in chain-dotted outline (FIG. 3) and then back again. Thus the foreign body is thrown out by the wall part 28B and slides down the part 28A.

A photo-electric cell or other sensing device 52 monitors the height of the column of tobacco across the main part of the channel 25 and controls the speed of the band 6 so as to maintain the height of the column substantially constant or to ensure that it remains within predetermined limits. For example, the band 6 may be arranged to run at either of two speeds, e.g. as disclosed in U.S. Pat. No. 3,062,357, and the sensing device may comprise upper and lower photo-electric cells of which the upper cell slows down the band when a light beam directed to the cell is interrupted by the tobacco, and the lower cell speeds up the band when a light beam directed to it ceases to be interrupted by the tobacco. A second sensing device (similar to the sensing device 52) monitors and controls the height of the column of discard tobacco; for example, if the desired tobacco is removed from the filler stream by trimming, this second sensing device may control the speed of the roller 30 since that in turn controls the discard rate, the speed of the roller 30 being, for example, adjustable stepwise or continuously between the upper and lower limits which may differ by approximately 2%.

Tobacco shorts, the relatively short particles of tobacco in the main body of new tobacco 4 received from the reservoir 2 and which become separated from the main body of tobacco, fall through a perforated curved plate 54 which is adjustable in its position about the axis of the drum 20 to permit, for example, control of the rate of shorts separation. The dotted lines to the left of carded drum, 20 in FIG. 1 show how the plate 54 can be swung clockwise about the axis of the drum 20, with corresponding upward adjustment of the wall 16, so as to decrease the shorts separation rate, or vice versa.

The shorts fall on to a downwardly inclined trough 56 which forms part of the vibratory assembly including the plate 50 and the wall 26 of the channel 25; the vibratory assembly is vibrated substantially vertically, for example by an electro-magnetic vibrator 51, which is shown connected by a link 53 to the plate 50. Thus the shorts pass down the trough 56 and then pass into a cylinder 58 via an intermediate short trough 60. The cylinder 58 is rotated slowly so as to feed the shorts downwards with a tumbling action as a result of which the shorts are delivered from the lower end of the cylinder at an averaged rate; i.e. with short-term variations in concentration of shorts smoothed out. The shorts leave the cylinder 58 through a perforated section 58A comprising the lower end of the cylinder; any pieces of long tobacco which enter the cylinder drop out through the open lower end of the cylinder. Thus a supply of shorts falls onto a downwardly inclined plate 61 which also forms part of the vibratory assembly so as to deliver the shorts through an opening 62 above the upstream end of the plate 34.

It will be seen from FIG. 2 that the shorts are delivered in the region where discard tobacco is being formed into a carpet, the shorts and discard tobacco being evenly mixed to form the carpet. However, a narrow part of width W3 of the carpet of discard tobacco is formed without shorts. The intention is that this part of the carpet may be showered first onto a band to form a tobacco stream; thus a layer of new tobacco is first formed on the band, followed by a layer consisting of discard tobacco mixed with shorts, and then finally by a thick layer of new tobacco. If the tobacco stream thus formed is trimmed, the arrangement is preferably such that only new tobacco (i.e. part of the thick layer) is removed by the trimmer.

The dwell time of the shorts in the cylinder 58 is adjustable by varying the speed of rotation or possibly the angle of slope of the cylinder.

As shown in FIG. 4, in place of the cylinder 58, it is possible to use a downwardly inclined flat-bottomed tray 64 which receives the shorts from the lower end of the trough 56 and feeds them in generally the same direction as the cylinder 58 with the aid of vibration, this tray being part of the vibratory assembly. The downstream end of the tray (i.e. the left hand end as seen in FIG. 4) terminates at an edge extending obliquely across the tray from a point 64A to the lower end of the tray so that the stream of shorts delivered from the tray is spread part of the way across the plate 61.

It should be noted that the various vibratory parts (except the wall 26) for conveying tobacco are inclined to the horizontal by comparatively small angles such that the tobacco does not slide down when the machine is stopped.

The frequency of vibration of the vibratory assembly is, for example, 1300 cycles/minute.

One or both walls of the channel 25 may be made of ultra-high molecular weight polyethylene for the sake of its low friction.

FIG. 5 shows an alternative arrangement for feeding tobacco into the space 18 adjacent to the drum 20. Instead of tobacco being accumulated in a reservoir space, it is fed continuously at the required rate by air through a pipe 66 and then via an air extractor 68 and into a channel 70. This channel is thicker than the channel 25 and is defined by a fixed wall 70A and a band 70B, the arrangement being basically as described in British Pat. No. 1,192,177. A column of tobacco is thus built up in the channel 70, and the tobacco is fed from the bottom end of the channel 70 by a picker roller 72 which throws the tobacco into the space 18.

By way of example, the tobacco speeds at various places in the hopper may be as follows. The peripheral speed of the carded drum 20 may be about 100 cms/second, for which purpose the picker roller 24 may rotate with a peripheral speed of about 300 cms/second; the speed at which the tobacco carpet in the channel 25 moves down the channel may be approximately 12 to 13 cms/second; and the peripheral speed of the carded drum 30 may be 14 to 15 cms/second.

I claim:

1. A hopper for a cigarette making machine comprising spaced walls defining a downwardly extending channel, a rotatable picker roller adjacent the upper end of said downwardly extending channel, a rotatable spiked drum adjacent said picker roller, a wall extending downwards towards one side of said spiked drum to form a space between the confronting surface of said wall and the peripheral surface of said spiked drum, means for continuously showering tobacco into said space, means for rotating said spiked drum in a direction such that its peripheral surface adjacent said wall moves upwards to carry said tobacco substantially immediately, after entry into said space, from said space towards said picker roller, said picker roller being adapted to remove said tobacco from said spiked drum and project it into the upper end of said downwardly extending channel whereby the tobacco accumulates in said channel to form a carpet, means for moving at least one wall of said channel to feed the carpet of tobacco downwardly through said channel, and conveyor means at the lower end of said channel adapted for receiving the carpet from the channel and for feeding the carpet towards a device for forming a cigarette filler stream from the carpet.

2. A hopper according to claim 1 in which the conveyor means at the lower end of the channel comprises a second spiked drum, and in which the channel is arranged to deliver the carpet of tobacco substantially tangentially on to the second spiked drum.

3. A hopper according to claim 2 including a second picker roller adjacent said second spiked drum and a plate adjacent both said second spiked drum and said second picker roller, said picker roller being arranged to remove the carpet of tobacco from the second spiked drum and to project the tobacco along said plate at a speed greater than the peripheral speed of said second spiked drum and the speed of the tobacco while being conveyed by the second spiked drum.

4. A hopper according to claim 2 further comprising a curved plate which extends part of the distance around the second spiked drum at a predetermined distance from the periphery of said drum, the distance between the confronting faces of said walls, in the direction substantially perpendicular to the axis of said drum, of said downwardly extending channel being only slightly greater than said predetermined distance between the periphery of said second spiked drum and said curved plate.

5. A hopper according to claim 4 in which said distance between the confronting surfaces of said walls is 11 to 15 mm.

6. A hopper according to claim 1 in which the walls defining said channel comprise an outer wall of the hopper and an inner wall, the inner wall being movable and the outer wall being stationary.

7. A hopper according to claim 6 in which at least one portion of the outer wall of the channel is pivotally mounted, said hopper including means for sensing the presence of a comparatively large foreign body entering said channel and to pivot said portion of the outer wall to provide access inside the channel to expel said foreign body.

8. A hopper according to claim 6 further comprising means for vibrating said inner movable wall of the channel.

9. A hopper according to claim 8 in which the channel is inclined to the vertical and in which the inner movable wall of the channel is above the outer wall.

10. A hopper according to claim 8 in which the inner movable wall of the channel is part of a movable assembly including at least one other member which is adapted to convey tobacco thereon into said channel, said vibrating means being arranged to vibrate said assembly.

11. A hopper according to claim 10 further comprising means for supplying discard tobacco, said movable assembly including a sloping plate arranged to receive said discard tobacco from said supply means and feed said discard tobacco towards and into said channel.

12. A hopper according to claim 11 in which the walls forming the channel extend laterally substantially coextensively with said first spiked drum to provide a main channel portion arranged to receive tobacco from the spiked drum and beyond one end of the first spiked drum to provide a secondary channel portion arranged to receive the discard tobacco from the sloping plate to form a carpet of discard tobacco in said secondary channel portion alongside the carpet formed from the tobacco fed into the main channel portion by the first spiked drum.

13. A hopper according to claim 12 further comprising means adjacent to said first spiked drum for separating tobacco shorts from the tobacco in said space, said movable assembly including a further sloping plate arranged to convey said tobacco shorts which separate from the tobacco in said space adjacent to the first spiked drum, said hopper further comprising means for feeding the tobacco shorts from said further sloping plate onto the carpet of discard tobacco after it emerges from the secondary channel.

14. A hopper according to claim 12 further comprising a third spiked drum coaxial with the second spiked drum for feeding the carpet of discard tobacco from the secondary channel portion and means for driving said third spiked drum separately from the second spiked drum.

15. A hopper according to claim 14 further comprising means for feeding the discard tobacco into the secondary channel portion.

16. A hopper according to claim 10 further comprising means adjacent to said first spiked drum for separating tobacco shorts from the tobacco in said space, the movable assembly including a sloping plate arranged to convey said tobacco shorts onto said carpet after it emerges from said channel.

17. A hopper according to claim 16 in which said means for separating tobacco shorts comprises a perforated plate spaced from and extending part of the distance around and underneath the first spiked drum, said perforated plate being angularly adjustable about the axis of the drum to vary the shorts separation rate.

18. A hopper according to claim 1 including means for monitoring the height to which tobacco delivered by the first spiked drum builds up in the channel, and for controlling the rate at which said means for continuously showering tobacco delivers tobacco into said chamber adjacent to the first spiked drum to maintain the height of the tobacco in the channel approximately constant.

19. A hopper according to claim 18 in which said means for showering tobacco into said space is adapted to deliver tobacco at a changing rate, said hopper further comprising means for driving the first spiked drum at a constant speed sufficient to carry tobacco from said space at the fastest rate at which tobacco is from time to time delivered into said adjacent space.

20. A hopper according to claim 19 wherein said means for showering tobacco into said space comprises a spiked conveyor arranged to deliver tobacco into said space adjacent to the first spiked drum, and means for driving said spiked conveyor selectively at either a higher or a lower speed, the speed at any given moment being controlled by said means for monitoring the height of the tobacco in the channel.

21. A cigarette making machine including means for enclosing a tobacco stream in a continuous wrapper web to form a continuous cigarette rod, discard means for removing a discard portion from the tobacco stream before the tobacco stream is enclosed in said continuous wrapper web, means defining a hopper comprising a downwardly extending channel, means including a spiked conveyor extending across a first part of the width of said channel for receiving new tobacco delivered into the hopper and for feeding the new tobacco into the upper end of the channel across said first part of the width thereof, means for feeding at least a part of the discard tobacco separately from the new tobacco and substantially directly into the upper end of the channel, bypassing said spiked conveyor, across a second part of the width of the channel alongside said first part, whereby a carpet of tobacco, is built up in the channel, formed of side-by-side portions of which one comprises new tobacco and the other comprises discard tobacco not containing new tobacco, and means for continuously feeding the carpet of tobacco from the lower end of the channel and for forming the carpet into said tobacco stream.

22. A cigarette making machine according to claim 21 including means for separating tobacco shorts from the new tobacco delivered into the hopper, and means for feeding the tobacco shorts on to the portion of the carpet which is formed from said discard tobacco.

23. A cigarette making machine according to claim 22 wherein said shorts feeding means includes a rotatably mounted hollow cylinder having its axis inclined to the horizontal whereby said shorts pass downwardly through the cylinder, the rotation of the cylinder serving to smooth the shorts flow.

24. A cigarette making machine comprising means defining a hopper including spaced walls defining a downwardly extending channel, means for feeding a first portion of tobacco of varying particle size into the upper end of the channel to build up a carpet of tobacco in the channel, means for separating the relatively short particles of tobacco from the first portion of tobacco before it enters the channel, the walls defining the channel comprising a fixed outer wall and an inner wall, the inner wall being part of a movable assembly including at least one sloping member and means for vibrating said movable assembly in a substantially vertical direction to move the carpet of tobacco downwards through the channel and to feed further tobacco along said sloping member.

25. A hopper for a cigarette making machine comprising feed means for delivering a metered flow of tobacco; a first conveyor having an upwardly moving surface portion, a wall extending downwards towards said upwardly moving surface portion of said first conveyor to form a space between the confronting surface of said wall and the upwardly moving surface portion of said first conveyor, means for driving said first conveyor, the feed means being arranged to shower tobacco into the space, and the first conveyor being adapted to carry the tobacco from the space substantially immediately upon arrival in the space; a downwardly extending channel defined by spaced walls; means for projecting the tobacco on the first conveyor into the upper end of the channel, whereby the tobacco piles up in the channel to form a continuous carpet; and second conveyor means for feeding the carpet of tobacco from the lower end of the channel.

26. A hopper according to claim 25 including means for collecting short particles of tobacco which drop from said space, passing between said confronting surface of said wall and the outwardly moving surface portion of said first conveyor and for conveying said short particles onto said carpet after it emerges from the lower end of said channel.

27. A hopper according to claim 25 further comprising means defining a buffer chamber for containing a mass of tobacco, said feed means comprising a spiked conveyor arranged to feed tobacco from said buffer chamber and rotary means cooperating with said spiked conveyor to project the tobacco downwards as a shower into the space.

28. A hopper according to claim 27 in which the first conveyor comprises a spiked drum and in which said means for projecting the tobacco comprises rotary picker means cooperating with the drum.

29. A hopper according to claim 28 in which the space is defined on one side by a fixed wall extending downwards towards one side of the drum, said hopper further comprising means for rotating the drum in a direction such that its side adjacent to said fixed wall moves upwards.

30. A hopper according to claim 29 in which the rotary picker means is mounted adjacent to the side of the drum remote from the fixed wall, said hopper further comprising means for rotating said picker means in the opposite direction to the drum and at a higher peripheral speed.

31. A hopper according to claim 29 including arcuate wall means forming an extension to said fixed wall extending towards the bottom of the drum and closely spaced from the drum, said arcuate wall means being perforated to allow tobacco shorts from the wall to drop through it; and including means below the acruate wall means for collecting the tobacco shorts.

32. A hopper according to claim 25 in which the channel has a predetermined, width, the feed means and the space extend across a first part of the width of the channel and the feed means is adapted to feed new tobacco, said hopper further comprising discard feed means for feeding discard tobacco into a second part of the width of the channel.

33. A cigarette making machine comprising a hopper for metering and feeding tobacco; and means for receiving the tobacco from the hopper and for forming a cigarette filler stream from the said tobacco and including means for removing a discard portion of the tobacco from the filler stream and for feeding that discard portion back into the hopper; the hopper comprising spaced walls defining a downwardly extending channel, first conveyor means of predetermined width for receiving new tobacco and for feeding the new tobacco into the upper end of the channel across a first part of the width thereof to form a column of new tobacco in said first part of said channel, said width of said conveyor means and of said first part of said channel being substantially the same; means for feeding at least part of the discard tobacco from said discard tobacco removing means substantially directly into the upper end of the channel across a second part of the width thereof to form a column of discard tobacco, not containing said new tobacco, in said second part of said channel alongside said column of new tobacco to form a carpet comprising side-by-side columns, considered in the horizontal direction, of new and discard tobacco respectively, and means for feeding said carpet of tobacco from the lower end of the channel, said carpet comprising side-by-side strips, considered in the horizontal direction, of new tobacco and discard tobacco respectively.

34. A hopper according to claim 33 wherein said means for feeding said tobacco carpet comprises two separate spiked conveyors for respectively feeding said two strips from the lower end of the channel and separate means for driving said separate spiked conveyors at different speeds.

35. A hopper for a cigarette making machine comprising feed means for delivering a metered flow of tobacco; a first conveyor having an upwardly moving surface portion; a wall extending downwards towards said upwardly moving surface portion of said first conveyor to form a space between the confronting surface of said wall and the upwardly moving surface portion of said first conveyor; a second conveyor for conveying the tobacco after it has left the first conveyor; means for collecting short particles of tobacco which drop from said space, passing between said confronting surface of said wall and the upwardly moving surface portion of said first conveyor and for delivering said short particles onto the second conveyor, where they recombine with the tobacco received from the first conveyor; the feed means being arranged to shower tobacco into the space, and the first conveyor being adapted to carry the tobacco from the space, apart from said short particles, substantially immediately upon arrival in the space.

* * * * *